US007197793B2

(12) United States Patent
Thordahl

(10) Patent No.: US 7,197,793 B2
(45) Date of Patent: Apr. 3, 2007

(54) FORMER HEAD WITH ADJUSTABLE NEEDLE ROLLERS

(75) Inventor: Jens Erik Thordahl, Rønde (DK)

(73) Assignee: Dan-Web Holding A/S, Risskov (DK)

( * ) Notice: Subject to any disclaimer, the term of this patent is extended or adjusted under 35 U.S.C. 154(b) by 365 days.

(21) Appl. No.: 10/487,340

(22) PCT Filed: Aug. 20, 2002

(86) PCT No.: PCT/DK02/00545

§ 371 (c)(1),
(2), (4) Date: Mar. 22, 2004

(87) PCT Pub. No.: WO03/016605

PCT Pub. Date: Feb. 27, 2003

(65) Prior Publication Data

US 2004/0231108 A1 Nov. 25, 2004

(30) Foreign Application Priority Data

Aug. 20, 2001 (DK) ..... 2001 01233

(51) Int. Cl.
*D01G 25/00* (2006.01)

(52) U.S. Cl. ..... 19/306

(58) Field of Classification Search ..... 19/144, 19/145.5, 148, 296, 299–301, 304, 305, 308, 19/161.1; 264/516, 518; 425/83.1
See application file for complete search history.

(56) References Cited

U.S. PATENT DOCUMENTS 3,252,186 A * 5/1966 Oja ..... 425/82.1
4,332,756 A * 6/1982 Bean et al. ..... 264/70
4,351,793 A * 9/1982 Day ..... 264/518
4,495,119 A * 1/1985 Chung ..... 264/37.28
4,640,810 A * 2/1987 Laursen et al. ..... 264/518
5,558,832 A * 9/1996 Noel et al. ..... 264/510
6,233,787 B1 * 5/2001 Eriksen et al. ..... 19/306
6,726,461 B2 * 4/2004 Hyvarinen et al. ..... 425/80.1

FOREIGN PATENT DOCUMENTS

| | | |
|---|---|---|
| EP | 168957 | 1/1986 |
| GB | 2141150 | 12/1984 |
| WO | WO 86/00097 | 1/1986 |
| WO | WO 99/36623 | 7/1999 |

* cited by examiner

*Primary Examiner*—Gary L. Welch
(74) *Attorney, Agent, or Firm*—James Creighton Wray

(57) ABSTRACT

A former head allows processing of long fibers while achieving a carding action and a fibre distribution fulfilling high quality standards. The former head contains at least one needle roller. A mixture of air and fibers are injected above the horizontal plane of a center axis of the needle roller and directly onto a periphery of the needle roller. There may be a number of adjustable needle rollers. With a former head, where fibers and air are injected in a controlled and new way, it is possible to process longer fibers and maintain a high distribution quality. By using a number of adjustable needle rollers, the fibre material can go through a carding process during the distribution. This carding process is optimized by the needles injecting onto the periphery of the stationary needle roller as well as the subsequent contact with the adjustable needle rollers.

14 Claims, 4 Drawing Sheets

FORMER HEAD WITH ADJUSTABLE NEEDLE ROLLERS

This application claims the benefit of Danish Application No. PA 2001 01233 filed Aug. 20, 2001 and PCT/DK02/00545 filed Aug. 20, 2002.

BACKGROUND OF THE INVENTION

The present invention concerns a former head with needle rollers of the kind used in dry formation of fibrous tissue, where a fibre material is supplied to the former head mixed with air via one or more injection nozzles.

From the industry there are known former heads where at the ends of rotating perforated cylinders a mixture of fibres and air is injected. Within the cylinders, a needle roller, also rotatable, is suspended and keeps the individual fibres afloat so that clotting does not occur before the fibres are sucked with vacuum through the perforation in the cylinder and are fixed on an underlying former wire.

From U.S. Pat. No. 3,252,186 is furthermore known a former head with needle rollers co-operating in pairs, where the rotational speed of the rollers are different in a ratio up to 1:3, i.e. one rotates at e.g. 900 rpm, whereas the other rotates at 2700 rpm. Allegedly, a kind of impact crusher effect separating the fibres is here achieved. The technique according to U.S. Pat. No. 3,252,186, however, has the drawback that the fibre distribution does not become very good, as the fibres are released from the roller set over a relatively small length in the longitudinal direction of the underlying former wire. A variant of the art according to U.S. Pat. No. 3,252,186, may comprise two sets of needle rollers or beater rollers acting in pairs and with variable overlap. These two sets are, however, placed immediately above each other, which does not give an improved distribution of the fibres. The fibre supply to this former head occurs by means of conveyor belts from which fibres are sprinkled down between the two co-operating rollers. Alternatively, air nozzles may be mounted, supplying air to the area between the rollers in order thereby to improve the distribution quality of the fibres.

With a former head according to the invention it has been realised that a markedly improved capacity and distribution quality of fibre may be attained, where the length is about 2 mm or more compared with a product formed in traditional former heads.

SUMMARY OF THE INVENTION

It is the purpose of a former head according to the invention to indicate an apparatus and a method allowing processing of long fibres, where a carding effect and a fibre distribution fulfilling high quality standards are achieved, and where adjusting may be performed simultaneously with the apparatus operating.

The former head according to the invention has means ensuring that a mixture of air and fibres are injected via at least one injection nozzle with regulating means at least one, preferably two, of the sides in the former head facing the longitudinal direction of the former wire, where the injection nozzle is placed in the entire width of the former head, where the former head at least one side of injection contains at least one first needle roller, preferably one stationary needle roller, where a mixture of air and fibres is conducted to the former head from the injection nozzle at a level over the horizontal plane in which the centre axis of the needle roller is situated, and directly onto the periphery of the needle roller, where the first needle roller is covered at the top side by an adjustable screen shaped like the periphery of the needle roller, and where the screen is equipped at the underside with means for separating fibres, preferably in the shape of carding ribs, needle strips, rasping plates or similar, and where the bottom of the former head is covered by needle rollers.

With a former head according to the invention, where fibres and air are supplied in a controlled and new way through the said adjustable injection nozzles, there is achieved possibility of processing fibres being longer than normal, while at the same time there is maintained a distribution quality being fully at level with the prior art.

The adjustable screen can be regulated during operation, if necessary, and has the purpose of contributing to the cutting up of the fibres to be formed. When the fibres are blown out of the injection nozzles with high speed—100 m/s or more—they are led into the former head by the needles and further on into the gap between the screen and the needle roller. Means provided at the inner side of the screen her provide for separation of the fibres, whereby a very uniform structure in the fibre-air Mixture is effected.

In order to set the former head for optimal operation, the individual direction of rotation of the needle rollers may be optional as well as the individual rotational speed may be regulated. With these control options there is achieved a former head which can be adapted to a large amount of different fibre types which are not readily processed with the same capacity on traditional apparatuses.

A preferred embodiment of a former head according lo the invention may at an injection side have two or more independently regulated injection nozzles disposed side by side across the width of the former head. E.g. there may be three injection nozzles which, depending on the air flow and other parameters, like the mix ratio of fibres and air, may be regulated individually in order thereby to adapt the properties of the dry formed product.

At an injection side, the former head may be provided with at least one other needle roller, which is disposed at an underlying horizontal plane relative to the plane of the stationary needle roller, where the other needle roller is displaceable in relation to the stationary needle roller at an angle lying in the interval between 0° and 90°, preferably in the interval between 40° and 50° relative to horizontal, and where the periphery of the two needle rollers at least may touch each other.

By having a second, displaceable needle roller, it may be regulated how the fibres are carded and/or distributed. By displacing the roller through an angle between 40° and 50° relative to horizontal, there is achieved possibility of changing the distance between the centre axes of the two rollers and thereby the distance between the periphery of the two rollers.

In a preferred embodiment, the former head may be equipped at a side of injection with at least one third needle roller, which is situated at a third plane under the plane of the stationary needle roller and under the plane of the second needle roller, where the third needle roller is independently displaceable in horizontal direction and in vertical direction, and where the periphery of the second needle roller at least touches the periphery of the third needle roller.

With this third roller there is also possibility of a displacement relative to the two previously mentioned rollers, and thereby is achieved an optimal distribution of fibres over the entire width and length of the former head. The third roller may, as mentioned, be regulated both vertically and horizontally, whereby the three mutually superposed rollers may largely form a row of rollers directed about 45° in relation to horizontal. By using a number of needle rollers that may be adjusted, there is achieved the further advantage of the fibre material really going through a carding process during the distributing. This carding process is effected by the fibres being processed by injection into the periphery of the stationary needle roller as well as by the subsequent contact with the adjustable needle rollers.

The former head may be arranged with needle rollers at two sides of injection. With this configuration, there may be achieved a former head with large capacity and with good distribution quality of the fibres, where the rollers are V-shaped as seen from side.

Alternatively, the former head may be provided with only two needle rollers disposed as the above indicated first needle rollers, each having their adjustable screen with carding means, where in this version the distance between the needle rollers can be regulated.

In a preferred variant, the needles on the needle rollers are positioned mutually displaced in the longitudinal direction of the rollers, so that overlap of the periphery of the rollers is allowed. The needle rollers in the second and third plane are mutually displaceable as well as displaceable in relation to a stationary needle roller in such a way that a variable overlap is formed between the needles of the rollers, ranging from no overlap to an overlap substantially corresponding to the length of the needles. With this variable overlapping there is possibility of adjusting the operation to many types of fibre for achieving a high quality fibre distribution.

In order to ensure a reasonable air flow in the former head, a downwardly directed air flow is supplied under an upper needle roller, being mainly directed as a tangent to the periphery of the stationary needle roller, and altemativly to the second needle roller and the third needle roller, where additionally an amount of air is injected directly down into the former head from above, and where there is possibility for introducing a material, preferably a super absorbing material, from a dosing apparatus arranged for the purpose and directly down into the former head.

The mix of air and fibres is fed to the former head from an annular supply duct, where inlet stubs are disposed at the corners in such a way as to circulate the mixture of air and fibres, and where it is possible to use all stubs or two diagonally disposed stubs or another combination. Depending on the kind of fibre applied, different injection patterns may be chosen. In an alternative embodiment, the annular supply duct can be substituted by independent injection stubs, each supplied from a central supply duct or similar.

A former head according to the invention may be partially and controllably delimited upwards, preferably with a perforated plate. With this controllable limitation there is achieved possibility of controlling the mix ratio between ambient air and air-fibre mixture from the injection nozzles, whereby a desired increased part of air through the injection nozzles is achieved.

In the following, the invention is described with reference to the drawing, which, without being limiting, shows a preferred embodiment of a former head according to the invention, where:

DETAILED DESCRIPTION OF THE PREFERRED EMBODIMENTS

Figure 1:
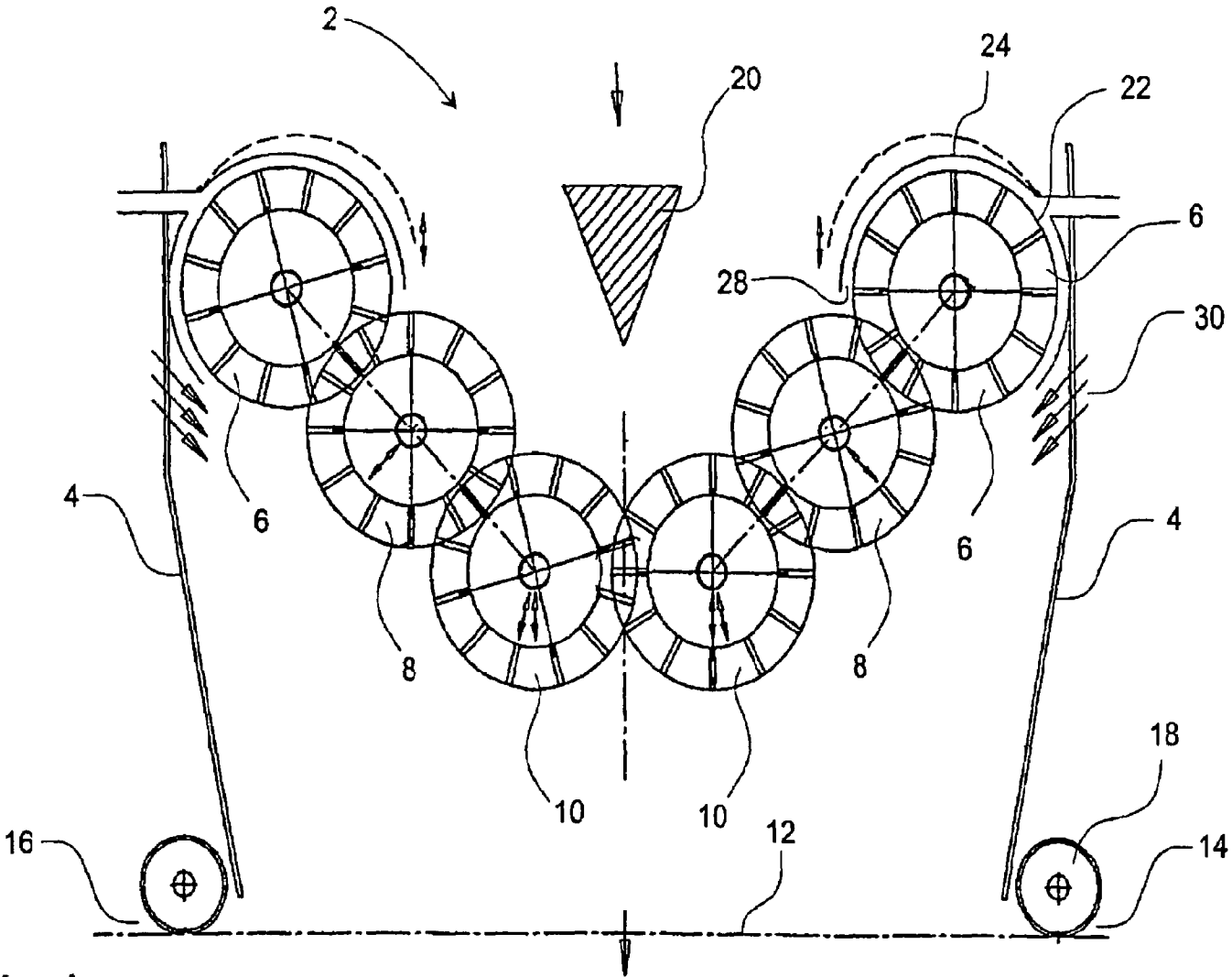
FIG. 1 shows a former head seen from one end.

FIG. 1 shows a former head 2 as seen from the side, with two injection sides 4 and six needle rollers 6, 8, 10 in total. At the top there are two stationary rollers 6, and below them there are two rollers 8, which can be adjusted according to each their straight line with an angle of 45° in relation to horizontal where the lines meet at the middle of the former head 2. Under these rollers 8 there are disposed two needle rollers 10 in addition, which are adjustable both in vertical and horizontal direction. Under the lower-most rollers 10 is seen the former wire 12 onto which the fibres are fixed. At the inlet 14 and the outlet 16 of the former head 2 there are guide rollers 18. At the top in the former head 2 there is a dosing apparatus 20 from where material may be dosed directly upon the needle rollers 6, 8, 10. The fibres supplied to the former head 2 are injected into the periphery 22 of the upper rollers 6 at the sides of injection 4 of the former head. Above the stationary needle rollers 6 there is an adjustable screen 24 provided with carding ribs 26 at the underside, and which is provided with a gap 28 over the rollers 6. An air intake 30 is provided under the stationary needle rollers 6, the air being led in a downward slanting direction in line with the underside of the rollers 6, 8, 10.

Figure 2:
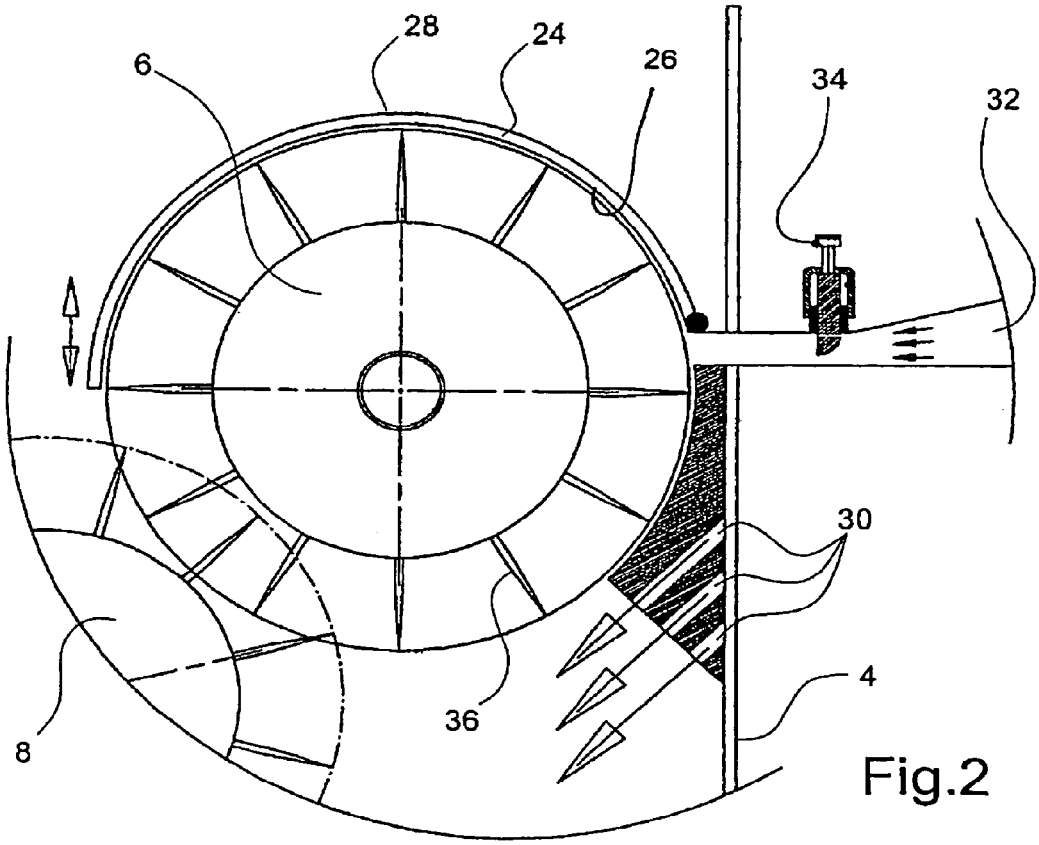
FIG. 2 shows a detail of FIG. 1 with injection details.

FIG. 2 is a detail of air regulating means 34 in an injection nozzle 32, where also the adjustable screen 24 with carding ribs 26 is seen, and the gap 28 appearing under the screen 24.

Figure 3:
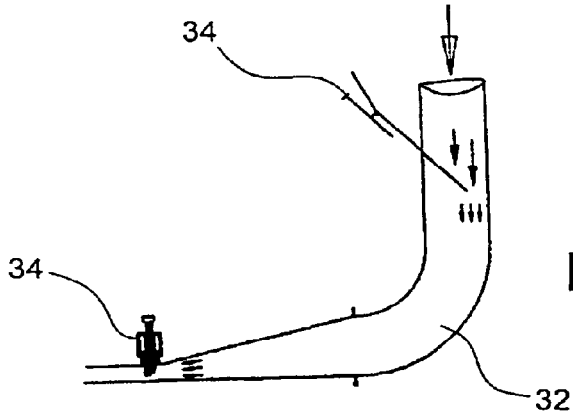
FIG. 3 shows a cross-section of an injection nozzle.

In FIG. 3 is seen an injection nozzle 32 with regulating means 34.

Figure 4:
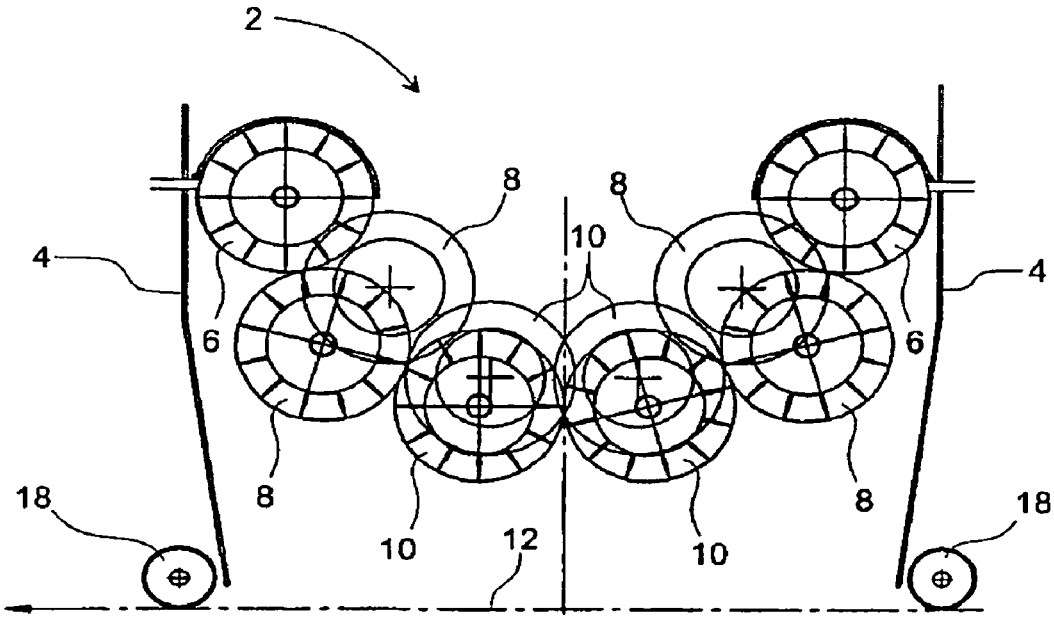
FIG. 4 shows a former head with needle rollers from the side.

FIG. 4 shows, as FIG. 1, a former head 2 from the side, but here the needle rollers 6, 8, 10 are shown in two different situations. A situation where the rollers 6, 8, 10 are placed so that there is a small overlap 38 of the needles 36 and a second situation where there is a large overlap 38 of needles 36 on the co-ordinated needle rollers 6, 8, 10, substantially corresponding to the length 50 of the needles 36.

Figure 5:
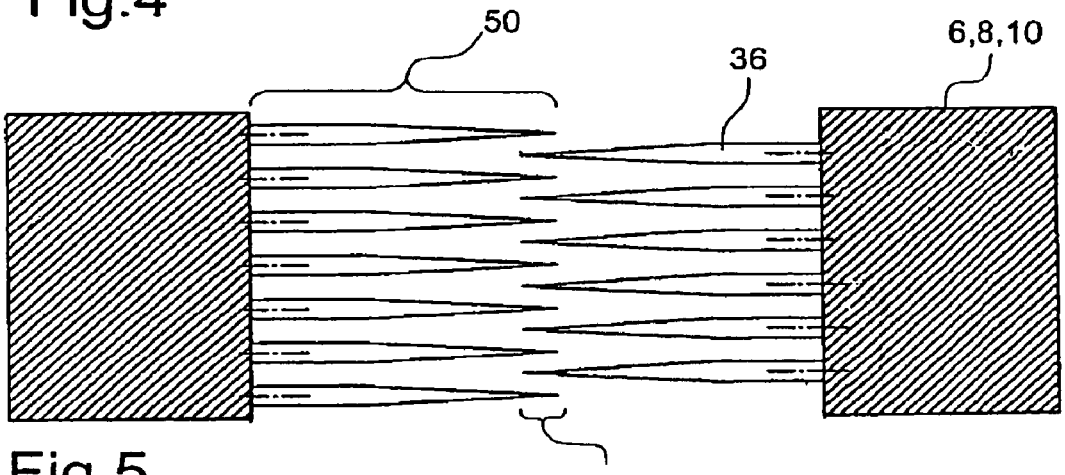
FIG. 5 shows needle rollers with small overlapping.
Figure 6:
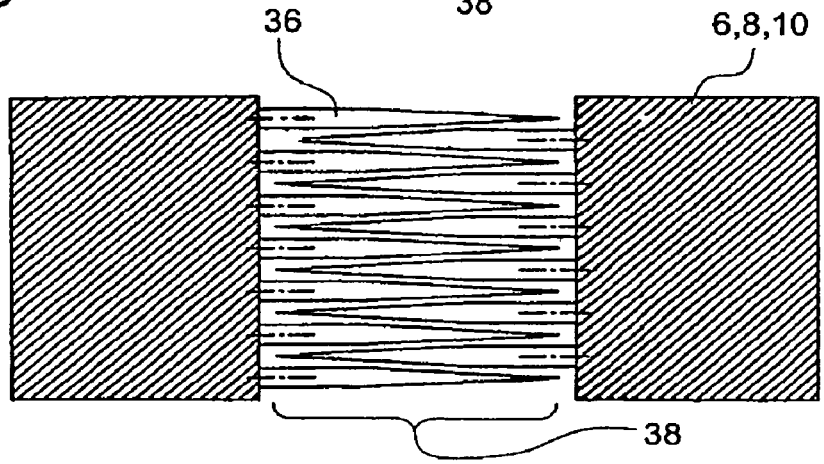
FIG. 6 shows needle rollers with larger overlapping.

On FIGS. 5 and 6 are seen two different settings of overlap 38 of the needles 36. FIG. 5 shows the situation corresponding to the rollers 6, 8, 10 shown as the lowermost on FIG. 4, whereas FIG. 6 shows the situation corresponding to the rollers 6, 8. 10 shown with thin line at the top in FIG. 4.

Figure 7:
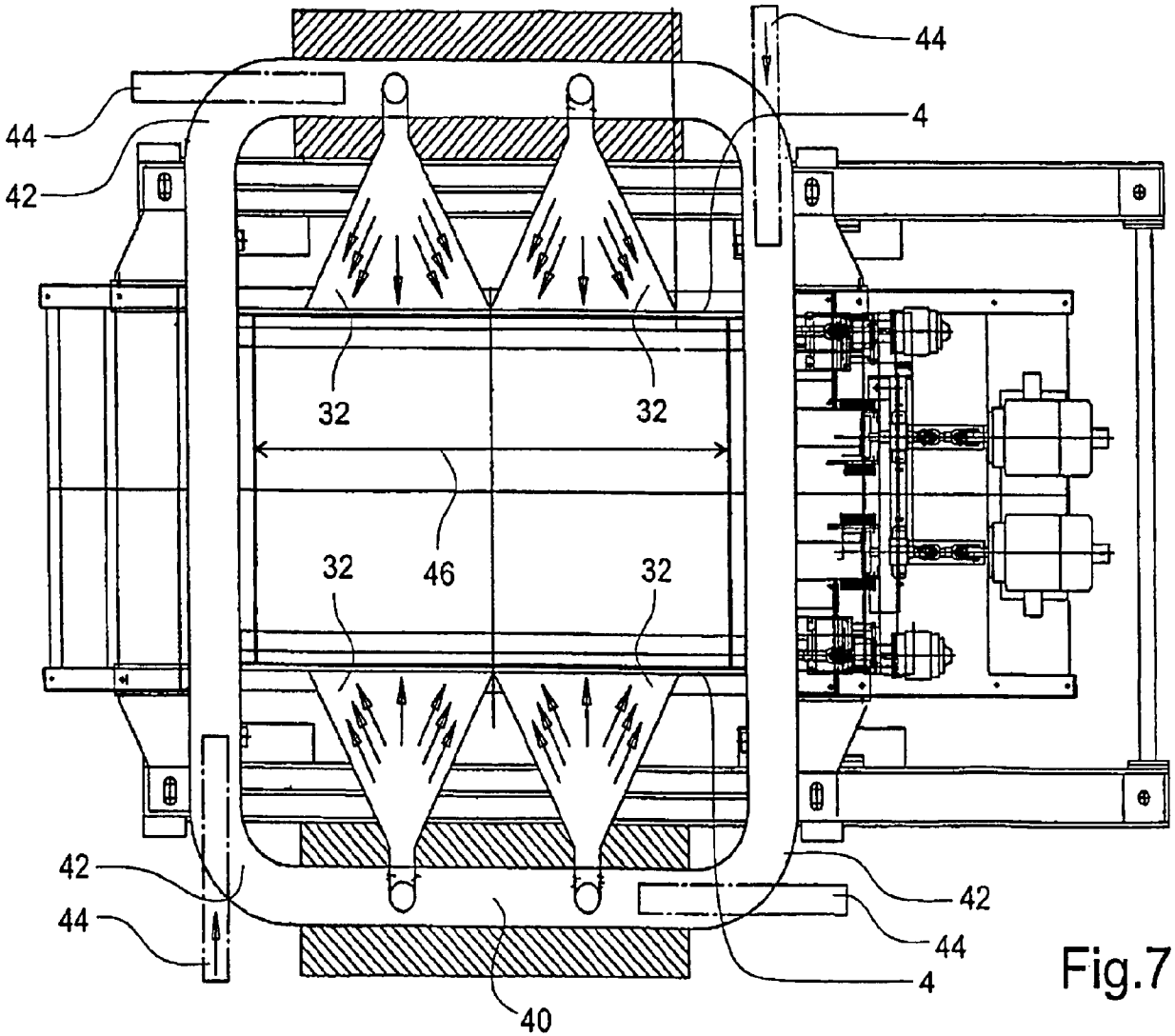
FIG. 7 shows a former head as seen from above.

FIG. 7 shows a former head 2 as seen from above, where the annular supply duct 40 is seen. In every corner 42 of this embodiment there are disposed inlet stubs 44 through which a mixture of fibres and air can be supplied. The mix of air and fibre is conducted from this annular supply duct 40 down to the supply nozzles 32 seen in FIG. 3, and further on directly onto the periphery 22 of the stationary needle rollers 6 and further in under the carding screen 24. Furthermore, the width 46 of the former head appears.

The invention claimed is:

1. A former head with needle rollers of the kind used in dry formation of fibrous tissue, where a fibre material is supplied to the former head mixed with air via one or more injection nozzles, wherein the former head has at least one injection nozzle with regulating means at least one of the sides in the former head facing the longitudinal direction of a former wire, where the injection nozzle is placed in the entire width of the former head, where the former head at least one side of injection contains at least one first stationary needle roller, where a mixture of air and fibers is conducted to the former head from the injection nozzle at a level over the horizontal plane in which the center axis of the needle roller is situated, and directly onto the periphery of the needle roller, where the first needle roller is covered at the top side by an adjustable screen shaped like the periphery of the needle roller, and where the screen is equipped at the underside with means for separating fibers, and where the bottom of the former head is covered by needle rollers.

2. A former head according to claim 1, wherein the former head at a side of injection is provided with two or more individually controllable injection nozzles disposed side by side over the width of the former head.

3. A former head according to claim 1, wherein the former head is equipped at a side of injection with at least one other needle roller which is disposed at an underlying horizontal plane relative to the plane of the stationary needle roller, where the other needle roller is displaceable in relation to the stationary needle roller at an angle lying in the interval between 0° and 90°, relative to horizontal, and where the periphery of the two needle rollers at least touch each other.

4. A former head according to claim 3, wherein the angle the at least one other needle roller is displaceable in relation to the stationary needle roller is between 40° and 500° relative to horizontal.

5. A former head according to claim 1, wherein the former head is equipped at a side of injection with at least one third needle roller, which is situated at a third plane under the plane of the stationary needle roller and under the plane of the second needle roller, where the third needle roller is independently displaceable in horizontal direction and in vertical direction, and where the periphery of the second needle roller at least touches the periphery of the third needle roller.

6. A former head according to claim 1, wherein the former head is arranged with needle rollers at two sides of injection.

7. A former head according to claim 1, wherein the needle rollers in the second and third plane are mutually displaceable as well as displaceable in relation to a stationary needle roller in such a way that a variable overlap is formed between the needles of the rollers, ranging from no overlap to an overlap substantially corresponding to the length of the needles.

8. A former head according to, claim 1 wherein a downwardly directed air flow is supplied under an upper needle roller, being mainly directed as a tangent to the periphery of the stationary needle roller, the second needle roller and the third needle roller, where additionally an amount of air is injected directly down into the former head from above, and where there is possibility for introducing a material from a dosing apparatus arranged for the purpose and directly down into the former head.

9. A former head according to claim 8, wherein the material is a super absorbent material.

10. A former head according to claim 1, wherein the former head has an annular supply duct for a mixture of fibers and air, where inlet stubs are disposed at the corners in such a way as to circulate the mixture of air and fibers, and where it is possible to use all stubs or two diagonally disposed stubs or another combination.

11. A former head according to claim 1, wherein the former head over the needle roller is partially and controllably delimited upwards.

12. A former head according to claim 1, wherein the means for separating fibers are carding ribs.

13. A former head according to claim 1, wherein the means for separating fibers are needle strips.

14. A former head according to claim 1, wherein the means for separating fibers are rasping plates.

* * * * *

UNITED STATES PATENT AND TRADEMARK OFFICE

CERTIFICATE OF CORRECTION

PATENT NO. : 7,197,793 B2
APPLICATION NO. : 10/487340
DATED : April 3, 2007
INVENTOR(S) : Jens Erik Thordahl It is certified that error appears in the above-identified patent and that said Letters Patent is hereby corrected as shown below:

Column 1, Line 62: Insert the word --at-- between the words “head” and “at”.

Column 2, Line 20: Delete the word “her” and substitute the word --here--.

Signed and Sealed this

Thirtieth Day of September, 2008

JON W. DUDAS
*Director of the United States Patent and Trademark Office*